United States Patent [19]

Ryder

[11] Patent Number: 4,853,979

[45] Date of Patent: Aug. 8, 1989

[54] RELEASABLE SECURING MEANS FOR AN INFANT'S SHIRT

[76] Inventor: Judith A. Ryder, 5064 Gaviota Ave., Encino, Calif. 91436

[21] Appl. No.: 197,706

[22] Filed: May 23, 1988

[51] Int. Cl.[4] ..... A41F 17/00

[52] U.S. Cl. ..... 2/326; 2/332

[58] Field of Search ..... 2/326, 327, 328, 332, 2/333, 334

[56] References Cited

U.S. PATENT DOCUMENTS

| | | | |
|---|---|---|---|
| 14,123 | 6/1896 | 1 | 12/333 |
| 311,111 | 1/1885 | Eisler | 2/326 |
| 755,188 | 3/1904 | Tooker | 2/326 |
| 863,970 | 8/1907 | Ebersole | 2/326 |
| 942,323 | 12/1909 | Haywood | 2/326 |
| 949,827 | 2/1910 | Kurtz | 2/332 |
| 1,320,641 | 11/1919 | McCain | 2/334 |
| 1,404,719 | 1/1922 | Postl | 2/326 |
| 1,638,304 | 8/1927 | Guy | 2/326 |
| 1,653,288 | 12/1927 | Johnson | 2/326 |
| 1,880,779 | 10/1932 | Cahn | 2/326 |
| 2,185,400 | 1/1940 | Cohen | 2/334 |
| 2,727,247 | 12/1955 | Bailey | 2/333 |

OTHER PUBLICATIONS

Maurice Gershman, "Self Adhering Nylon Tapes", *The Journal of the AMA,* p. 930, vol. 168, No. 7, dated Oct. 19, 1958.

*Primary Examiner*—Werner H. Schroeder
*Assistant Examiner*—Jeanette E. Chapman
*Attorney, Agent, or Firm*—George J. Netter

[57] ABSTRACT

A first elastic strip or ribbon is folded into V-shape and provided with two button-and-loop connectors at the ends for fastening to an infant's shirt front. A nonelastic strip is secured to the foldover point on the first elastic strip. A second elastic strip is formed into a V-shape and provided with button-and-loop connectors at its ends for fastening to the shirt back. Hook-and-loop connector halves are located on the nonelastic strip and base of the V on the second elastic strip for adjustable and releasable securement.

2 Claims, 1 Drawing Sheet

RELEASABLE SECURING MEANS FOR AN INFANT'S SHIRT

The present invention relates generally to infant's clothing and, more particularly, to a releasable means for securing a baby's shirt in place while it is being worn.

BACKGROUND OF THE INVENTION

It is well known that an infant's clothing readily becomes twisted and pulled out of normal position while it is being worn, which is not only lacking in aesthetic appearance, but also is uncomfortable to the infant in as a result of knots and lumps being formed.

In the past, an infant's garments such as a shirt, for example, was typically pinned to its other garments or diapers so as to prevent the shirt from twisting, turning or riding up high on the infant, for example. However, the use of pins in this connection are not completely satisfactory in that they can open and possibly injure the infant. Also, a safety pin can, if applied repeatedly to the same place on the shirt, can end up tearing the garment.

SUMMARY OF THE PRESENT INVENTION

In the practice of the present invention there is provided means for securing an infant's shirt in place consisting of two separable parts. The first separable part includes first and second elastic strips on the outer ends of which are a releasable fastening means (e.g., button clips). The other ends of the two elastic strips are secured as by stitching, for example, to a single elongated strip of material on a surface of which is one half of a hook and loop releasable connector.

The second part of the invention consists of two elongated strips of elastic material which can be identical to that of the first part, one end of each being secured to the other so that forming two equal length arms extending away from a common interconnection in a generally V-shape. The outer ends of each of the elastic strips includes a releasable fastening means. At the crossover interconnection between these two elastic strips there is provided the complementary or mating hook and loop connector.

In use, the first part has its two releasable fastening means snapped onto the back of the infant's shirt at spaced apart points with the strips carrying the hook and loop connector half being located between the infant's legs. The second part of the invention is similarly releasably connected to the front part of the infant's shirt at a spaced apart distance greater than that on the rear and then the two hook and loop complementary connectors are suitably adjusted for the size of the infant and interconnected by pressing together.

DESCRIPTION OF A PREFERRED EMBODIMENT

Figure 1:
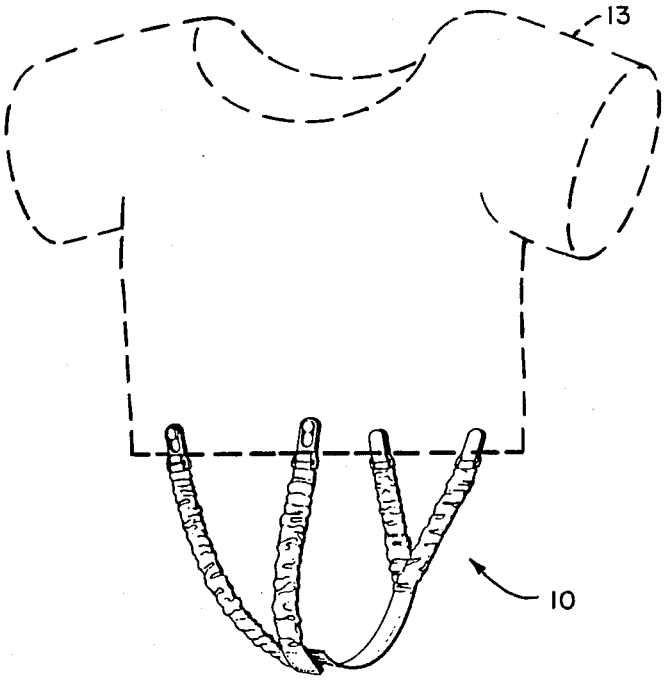
FIG. 1 is a perspective view of the invention shown holding an infant shirt securely in position so that it will not ride up or otherwise become bunched.
Figure 3:
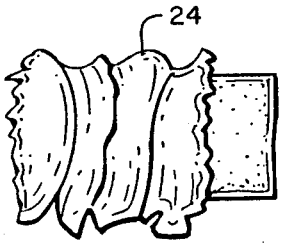
FIG. 3 is an enlarged, fragmentary, sectional view of a strip used in the invention.
Figure 2:
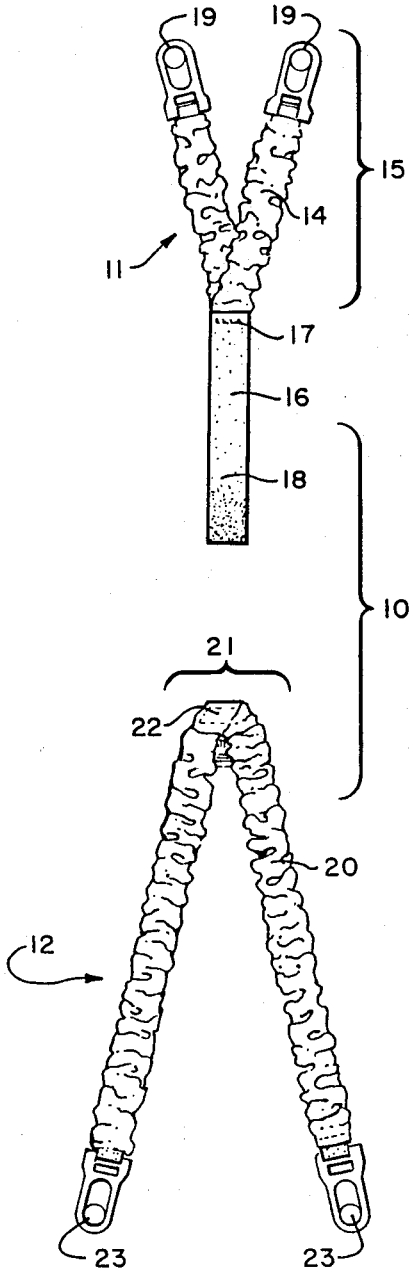
FIG. 2 is a view of the invention with the parts extended and separated.

With reference now to the drawing, the securing means of the invention, enumerated generally as 10, includes first and second parts 11 and 12 which in a way to be described releasably and adjustably interconnects with an infant's shirt 13. The securing means 10 serves to hold an infant's shirt in normal wearing relation on the child and is contemplated solely for use where the child is also wearing a diaper.

The first part 11 includes an enlongated strip 14 (e.g., 5 inches) of elastic material folded onto itself to form a V-shape elastic member 15 with equal length arms. A strip 16 of a non-elastic fabric material is preferably affixed to the foldover point of the member 15 by a line of stitching 17. One surface of the strip 16 is substantially covered with one-half of a hook and loop connector 18 which is sold commercially under the registered trademark VELCRO.

At the outer end of each V-shape member arm there is secured a button and connector 19 for making nondestructive connection with the shirt fabric.

The second part 12 of the invention includes a strip 20 of elastic material (e.g., 12 inches) which is folded onto itself to form a V-shaped construction 21 with two equal length arms. At the strip crossover point a second and complementary part 22 of the hook-and-loop connector is secured, preferably by stitching. Each end of the strip 20 includes a button and loop connector 23 which can be identical to the connector 19.

Although the strips 14 and 20 can be merely constructed of elastic ribbon, it has been found preferable to enclose the elastic ribbon within a loose fitting fabric tube 24 where the fabric is smooth to the touch. In this manner, not only is the appearance enhanced but the elastic on being stretched and relaxed cannot pinch the infant's skin.

In use, before the shirt 13 is placed on the child the first part 11 button and loop connectors 19 are grippingly applied to the shirt front. Next, the button and loop connectors 23 are applied to the shirt back. Now the child is dressed and the hook-and-loop connector secured together. The hook-and-loop connection technique not only makes adjustment easy, but is also convenient for diaper changing.

I claim:

1. An infant shirt securing device for use on an infant wearing a diaper, comprising:

a first part including, a first elastic strip folded onto itself forming two arms arranged in a generally V-shape, a button and loop connector secured to each end of the strip for releasable interconnection with the front of the shirt, and a nonelastic strip having an end secured to the folded over part of the elastic strip and extending oppositely of the arms, a second part including a second elastic strip longer than the first elastic strip folded onto itself forming two arms arranged in a generally V-shape, and a button and loop connector secured to each end of the elastic strip for releasable interconnection with the back of shirt; and a first half of a hook-and-loop connector secured to a surface of the nonelastic strip;

a second half of a hook-and-loop connector complementary to the first connector half secured to the second elastic where it is folded onto itself; and each elastic strip is enclosed within a separate fabric tube made of a material that has an external surface that is smooth to the touch.

2. An infant shirt securing device as in claim 1, in which the first elastic strip is approximately 5 inches long and the second strip is approximately 12 inches long.

* * * * *